US005327504A

United States Patent [19]

Hobelsberger

[11] Patent Number: 5,327,504

[45] Date of Patent: Jul. 5, 1994

[54] DEVICE TO IMPROVE THE BASS REPRODUCTION IN LOUDSPEAKER SYSTEMS USING CLOSED HOUSINGS

[76] Inventor: Maximilian H. Hobelsberger, Dorgstr;. 16, 5303 Wüenlingen, Switzerland

[21] Appl. No.: 942,710

[22] Filed: Sep. 10, 1992

[30] Foreign Application Priority Data

Oct. 5, 1991 [CH] Switzerland ..... 02928/91-5

[51] Int. Cl.[5] ..... H04R 3/00

[52] U.S. Cl. ..... 381/96; 381/159; 381/89

[58] Field of Search ..... 381/96, 159

[56] References Cited

U.S. PATENT DOCUMENTS 4,008,374 2/1977 Tiefenbrun ..... 381/89
5,191,619 3/1993 Hayase ..... 381/96

FOREIGN PATENT DOCUMENTS 63-77297 4/1988 Japan ..... 381/159
2122051 6/1982 United Kingdom ..... 381/96

*Primary Examiner*—Curtis Kuntz
*Assistant Examiner*—Mark D. Kelly

[57] ABSTRACT

The housings of the devices are divided by inner walls into two or three inner chambers. One of the inner chambers adjoins the membrane of the loudspeaker. Adjoining this inner chamber a membrane is built into an opening of an inner wall. Movements of the inner membrane, which are caused by pressure changes in this chamber, are servo supported by an inner electrodynamic transducer, whose membrane lies parallel behind the other inner membrane. The supporting movements are caused by a controller, which tries to hold constant the distance between the two inner membranes.

11 Claims, 2 Drawing Sheets

DEVICE TO IMPROVE THE BASS REPRODUCTION IN LOUDSPEAKER SYSTEMS USING CLOSED HOUSINGS

BACKGROUND OF THE INVENTION

1. Field of the Invention

This invention relates to sound reproduction systems with electrodynamic loudspeakers and closed housings. More particularly, the invention relates to a sound reproduction system for improved bass reproduction.

2. Prior Art

Conventional loudspeaker systems have an inferior bass reproduction if the housings are small. In small housings air compression forces will build up and hinder the movement of the radiating loudspeaker's membrane. These forces evolve from volume changes in the air inside the housing which are caused by the movement of the loudspeaker's membrane. The membrane compresses or decompresses the air and the resulting forces hinder the movement of the membrane. Being elastic forces they also increase the resonant frequency of the system.

To achieve a satisfying bass reproduction, large, impractical housings must be used, or different kinds of resonant boxes are employed. Often the driving signals are corrected in their frequency characteristic, or the loudspeakers are controlled by servo systems. All these solutions cause distortions or are impractical to use, or show a poor pulse response.

Another known method ( Tiefenbrun, U.S. Pat. No. 4,008,374) uses a second loudspeaker incorporated into the housing to simulate a larger volume. However this method just transfers the problems from the outer to the inner loudspeaker. To achieve satisfying results large housings must be used once again. Additionally, problems arise from distortions caused by phase differences between the movements of the membranes.

SUMMARY OF THE INVENTION

The inventions as defined by the claims improve the bass reproduction of loudspeaker systems with small housings and with large loudspeaker membranes. Neither a direct correction of the driving signals is used in the invented systems nor is a servo system for the radiating loudspeaker employed.

The above-mentioned results are achieved by the systems characterized by the claims. The invented systems are unique because of the fact that differences between the gas pressure inside the housing and the time-averaged mean pressure outside the housing are almost eliminated by the movements of a servo controlled membrane inside the housing. This membrane is part of a servo control system. It even reacts to very weak forces upon it by relatively strong movements in the direction of these forces. Thus virtually no pressure difference can build up between the inside the housing and the outside of the housing. Compression effects are therefore largely reduced.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
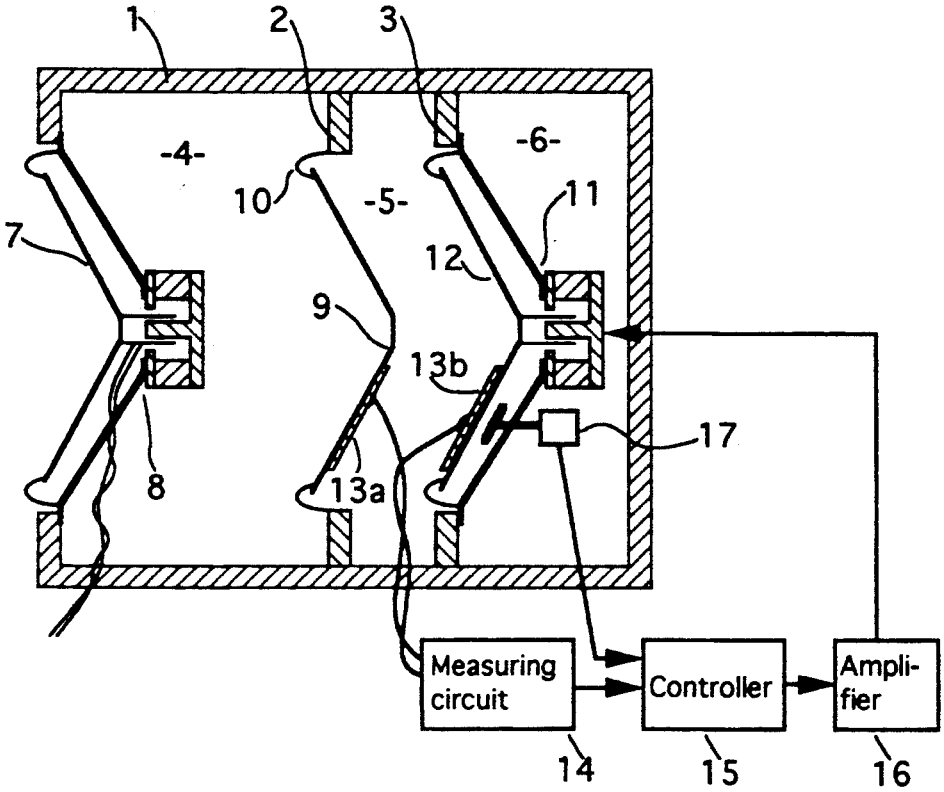
FIG. 1 is a schematic view of a speaker system that is a first embodiment of the present invention.

The following is a description of a first embodiment of the invention and refers to FIG. 1.

A loudspeaker 8 is built into an opening of the housing 1 with its membrane's 7 front face facing outwardly. The loudspeaker housing 1 is divided into three chambers, 4, 5, 6, by two soundproof and almost pressure-tight walls, 2, 3. The first chamber, 4, is enclosed by the membrane 7 of the outer, sound radiating loudspeaker, 8, by the walls of the housing, by the inner wall 2 and by an inner membrane 9. The stiff membrane 9 is built into an opening of the inner wall 2 so that it separates the chamber 4 from the chamber 5. It can be displaced very easily. Parallel to this membrane 9 an inner elektrodynamic transducer 11 is placed in a hole of the second inner wall 3. Its membrane 12 lies parallel to the other inner membrane 9 in the wall 2. Its distance from this membrane is small in comparison to the wavelength of acoustical low frequency waves. The diameter of the membrane 12 of the inner transducer 11 is a little bit smaller than the diameter of the other inner membrane 9.

The changes of the distance between the two membranes are measured. This measurement is achieved by using inductive, capacitive, resistive or piezoelectrical methods. FIG. 1 shows a capacitive sensor, consisting of two conducting layers 13*a*, 13*b* which are applied to the two inner membranes. An electrical circuit 14 produces an electrical signal which is proportional to the changes in distance. This signal is forwarded to a servo controller, 15, which is a PI- (proportional-integrating), or a PID (proportional-integrating-deriving) or preferably a state controller. The output signal of the servo controller is amplified by a power amplifier 16 which drives the inner transducer 11. The controller is dimensioned to hold the distance between the two inner membranes always constant, i.e. changes of the distance are almost suppressed by appropriate movements of the transducer's membrane 12.

The preferred state controller controls the distance of the membranes 9, 12 and its derivatives as well as the position of the membrane 12 of the inner transducer 11 and its derivatives (i.e. the state variables of the system). To achieve the latter, the position of the membrane 12 is measured by a sensor 17 and a proportional signal is conveyed to the controller 15. Because the position of the membrane is controlled, the dynamic behaviour of the transducer's membrane does not influence the other parts of the system. The swinging of the transducer's membrane is suppressed by the controller. Resonance effects of the inner transducer are suppressed and cannot influence the performance of the loudspeaker system.

Because the effective areas of the two inner membranes 9, 12 are almost equal and because the distance between both stays constant, the gas pressure in the middle chamber 5 between the membranes stays almost constant too. This holds true despite displacements of the first inner membrane 9 caused by pressure changes in the chamber 4. The inner membrane 9 reacts as if the inner volume 5 were very large. The edge of this membrane is attached with flexible material 10 to the inner wall 2 so that it can be easily displaced. Therefore, the pressure in the chamber 4 is also kept almost constant and the performance of the loudspeaker 8 is not disturbed by compression effects.

Figure 2:
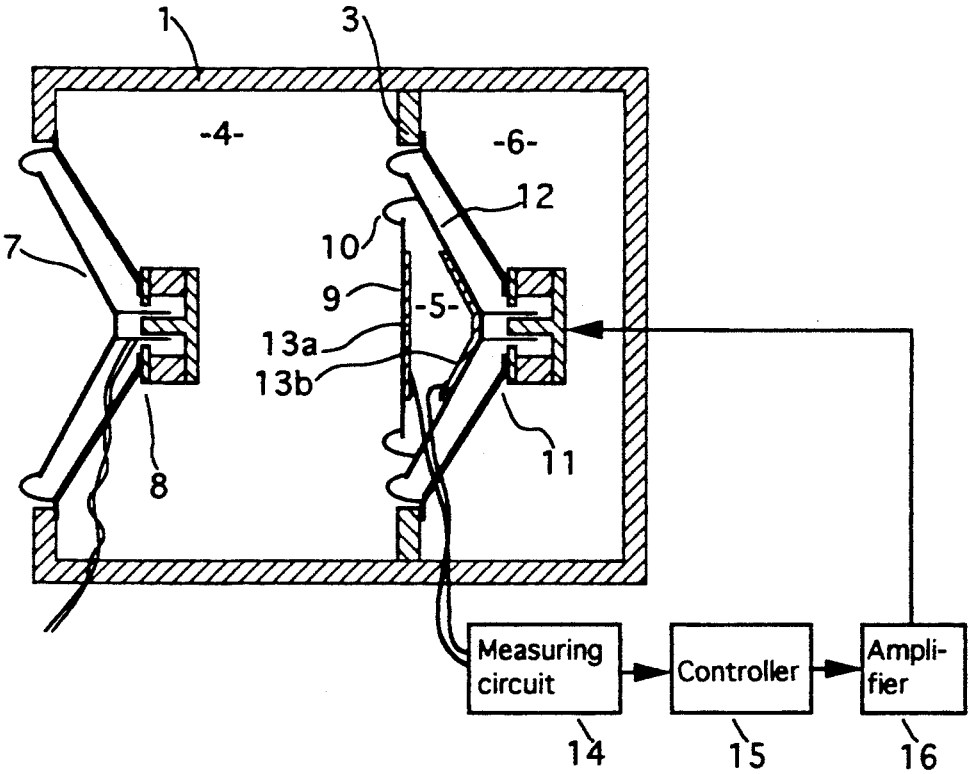
FIG. 2 shows a second embodiment of the invention.

The second embodiment shown by FIG. 2 is similar to the above described embodiment. However, the inner wall 2 has been omitted. A loudspeaker 8 with a membrane 7 is built into an opening of the housing 1. The housing 1 is divided into two chambers, 4, 6, by a soundproof and almost pressure-tight wall 3. The first chamber, 4, is enclosed by the membrane 7 of the outer, sound radiating loudspeaker, 8, by the walls of the housing and by the inner membranes 9 and 12. An inner elektrodynamic transducer 11 is placed in a hole of the inner wall 3. The inner membrane 9 is attached directly to the membrane 12 of the inner transducer 11, and the inner volume 5 is enclosed by the two inner membranes, 9, 12.

This device allows building quite simple housings with only one inner partition 3. In addition to this the force which is necessary to displace the inner membrane 9 is even reduced because of its attachment to the membrane 12 instead of being connected to a fixed wall. Furthermore, the diameter of the two inner membranes need not be almost equal as in the first embodiment.

As in the first embodiment the distance changes between the two inner membranes are measured. FIG. 2 shows a capacitive sensor, consisting of two conducting layers 13*a*, 13*b* which are applied to the two inner membranes. An electrical circuit produces an electrical signal which is proportional to the changes in distance. This signal is forwarded to a servo controller, 15. The output signal of the servo controller is amplified by a power amplifier 16 which drives the inner transducer 11. The controller holds the distance constant.

Figure 3:
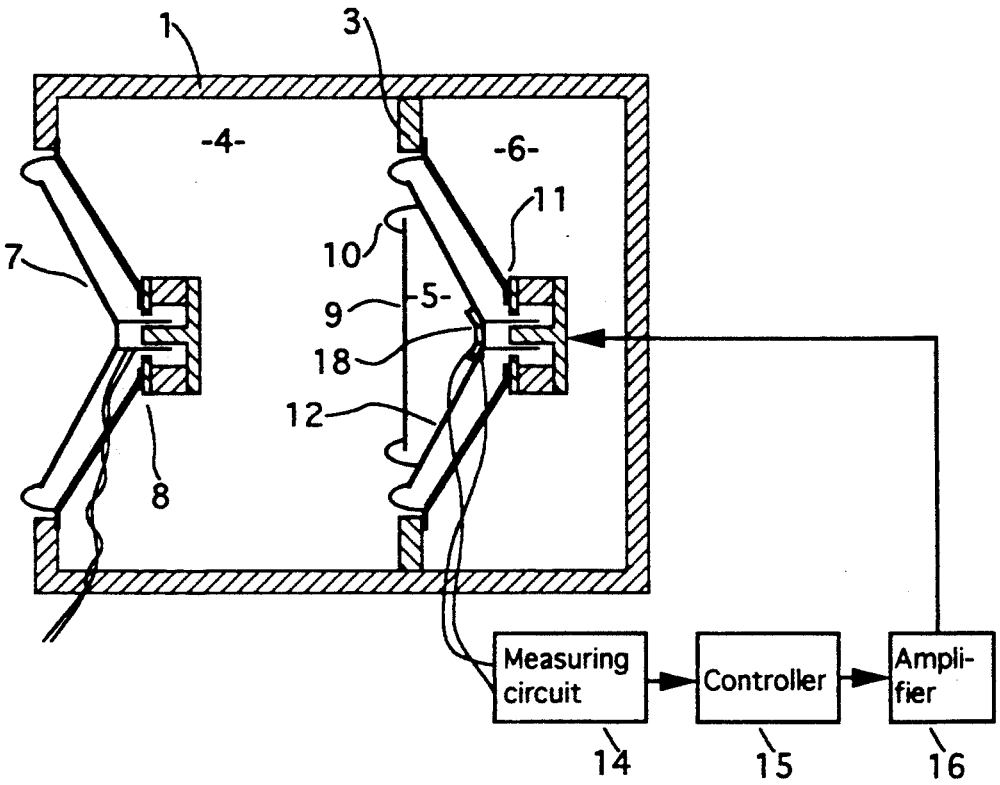
FIG. 3 shows a schematic view of a third embodiment of the invention.

The embodiment shown in FIG. 3 almost equals that one of FIG. 2. The only difference is that a pressure sensor 18 is placed within the chamber 5 and that the capacitive sensor is omitted. The pressure changes measured by the sensor are proportional to the distance changes between the two inner membranes. The signal produced by the sensor is forwarded to the measurement device 14. The output of this device is connected to the controller 15 which drives the inner transducer 11 via the amplifier 16.

Figure 4:
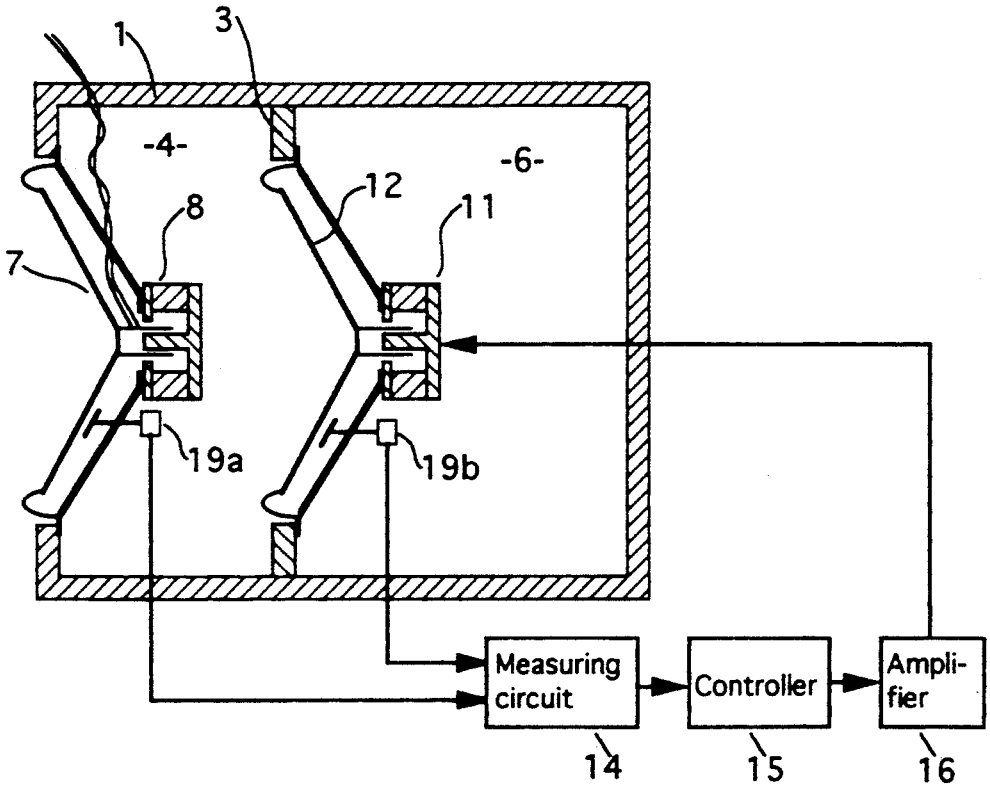
FIG. 4 shows a fourth embodiment of the invention.

FIG. 4 shows a fourth embodiment. A loudspeaker 8 with a membrane 7 is built into an opening of the housing 1. The loudspeaker housing 1 is divided into two chambers, 4, 6, by a soundproof and almost pressure-tight wall 3. The first chamber, 4, is enclosed by the membrane 7 of the outer, sound radiating loudspeaker, 8, by the walls of the housing and by the membrane 12 of the inner transducer 11. This inner electrodynamic transducer 11 is placed in a hole of the inner wall 3. The diameter of the inner membrane is a little bit smaller than that of the outer membrane. Distance changes between the outer loudspeaker's membrane 7 and the inner membrane 12 are measured. For this, two position sensors 19*a* and 19*b* are incorporated. A measurement device 14 produces a signal proportional to these changes. The controller 15 receives this signal. The controller is designed to hold constant the distance between the two membranes 7, 12. It drives the inner transducer 11 via an amplifier 16 and moves the transducers membrane 12. By doing this, a large inner volume is simulated.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

That which is claimed is:

1. A loudspeaker system with closed housing for improved bass reproduction, comprising:

an acoustically closed housing;

a loudspeaker being so mounted in said housing that its membrane's front faces outward of said housing;

two stiff, soundproof and pressure-tight walls dividing the inner volume of said acoustically closed housing into three chambers, whereby the first of said chambers is enclosed by the membrane of the loudspeaker, the first of said inner walls and the walls of the housing, the second of said chambers is enclosed by said two inner walls and the walls of said housing, and the third of said chambers is enclosed by said second inner wall and the walls of said housing;

a stiff and pressure-tight membrane, being built into an opening of said first inner wall and separating said first and said second inner chamber, this membrane being connected to said first inner wall by flexible material to enable it to move;

an electrodynamic transducer with a pressure-tight membrane, being built into an opening of said second inner wall and separating with its membrane said second and said third chamber, whereby the diameter of the inner transducer's membrane is smaller than that of said other inner membrane, and whereby the transducer's membrane lies parallel to said other inner membrane;

distance measuring means for measuring the changes of the distance between the two inner membranes and producing an electrical signal proportional to the changes of the distance;

a power amplifier, the output of said amplifier being connected to said inner transducer to drive said transducer;

an electrical controller, to the input of which the signal produced by said distance measuring means is applied, the output of said controller being connected to the input of said power amplifier, and said controller being dimensioned to keep the distance between said inner membrane and said inner transducer's membrane constant by causing said inner transducer's membrane to move.

2. A loudspeaker system with closed housing for improved bass reproduction, comprising:

an acoustically closed housing;

a loudspeaker being so mounted in the housing that its membrane's front faces outward of the housing;

a stiff, soundproof and pressure-tight wall dividing the inner volume of said acoustically closed housing into two chambers, whereby the first of said chambers is enclosed by the membrane of said loudspeaker, said inner wall and the walls of the housing, and the second of said chambers is enclosed by said inner wall and the walls of said housing;

an electrodynamic transducer with an pressure-tight membrane, being built into an opening of said inner wall and separating with its membrane said first and said second chamber;

a stiff and pressure-tight membrane, being smaller in diameter than said inner transducer's membrane, and being attached at its edge to said inner transducer's membrane so that a third inner chamber is enclosed by said inner membrane and said inner transducer's membrane, whereby said inner membrane is connected to said inner transducer's membrane by flexible, pressure-tight material which allows said membrane to be displaced in relation to said inner transducer's membrane, and whereby said membrane adjoins said first chamber;

distance measuring means for measuring the changes of the distance between said inner membrane and said inner transducer's membrane and producing an electrical signal proportional to the changes of the distance;

a power amplifier, the output of said amplifier being connected to said inner transducer to drive said transducer;

an electrical controller, to the input of which the signal produced by said distance measuring means is applied, the output of said controller being connected to the input of said power amplifier to drive the amplifier, and said controller being dimensioned to keep the distance between said inner membrane and said inner transducer's membrane constant by causing said inner transducer's membrane to move.

3. The loudspeaker system of claim 1 or of claim 2, wherein the surfaces of said two inner membranes, which lie opposite each other, are coated with an electrically-conducting material in such a way, that the two coating layers form a condenser with a capacitance inversely proportional to the distance between said two membranes, wherein the system comprises measuring means to measure changes of the capacitance of said condenser and to produce an electrical signal proportional to the capacitance changes, and wherein said signal is forwarded to said controller as a signal proportional to distance changes.

4. The loudspeaker system of claim 1 or of claim 2, wherein the position of said membrane of said inner transducer is measured, wherein said controller is a state controller, and wherein the controlled items are, firstly, the distance of said two inner membranes and their time derivatives, and, secondly, the position of said inner transducer's membrane and its time derivatives.

5. The loudspeaker system of claim 1 , comprising:

pressure measuring means, placed in said second chamber for measuring the changes of the pressure in said second chamber and producing an electrical signal proportional to the changes of the pressure;

wherein said signal is applied to the input of said controller as a signal proportional to the changes of the distance between said two inner membranes.

6. The loudspeaker system of claim 2, comprising:

pressure measuring means, placed in said third chamber for measuring the changes of the pressure in said third chamber and producing an electrical signal proportional to the changes of the pressure;

wherein said signal is applied to the input of said controller as a signal proportional to the changes of the distance between said two inner membranes.

7. The loudspeaker system of claim 5, wherein said pressure measuring means are made of polyvinylidene fluoride or other piezoelectric materials.

8. The loudspeaker system of claim 6, wherein said pressure measuring means are made of polyvinylidene fluoride or other piezoelectric materials.

9. The loudspeaker system of claim 5, wherein said pressure measuring means are attached to one of said inner membranes.

10. The loudspeaker system of claim 6, wherein said pressure measuring means are attached to one of said inner membranes.

11. A loudspeaker system with closed housing for improved bass reproduction, comprising:

an acoustically closed housing;

a loudspeaker being so mounted in the housing that its membrane's front faces outward of the housing;

a stiff, soundproof and pressure-tight wall dividing the inner volume of said acoustically closed housing into two chambers, whereby the first of said chambers is enclosed by the membrane of said loudspeaker, said wall and the walls of the housing, and the second of said chambers is enclosed by said inner wall and the walls of said housing;

an electrodynamic transducer with an pressure-tight membrane, being built into an opening of said inner wall and separating with its membrane said first and said second chamber, said membrane lying parallel to the membrane of said loudspeaker, and the diameter of said inner membrane being smaller than that of said loudspeaker's membrane;

distance measuring means for measuring the changes of the distance between the membrane of said loudspeaker and said membrane of said inner transducer and producing an electrical signal proportional to the changes of the distance;

a power amplifier, the output of said amplifier being connected to said inner transducer to drive said transducer;

an electrical controller, to the input of which the signal produced by said distance measuring means is applied, the output of said controller being connected to the input of said power amplifier to drive the amplifier, and said controller being dimensioned to keep the distance between said loudspeaker's membrane and said inner transducer's membrane constant by causing said inner transducer's membrane to move.

* * * * *